US008851435B1

(12) United States Patent
Bastien et al.

(10) Patent No.: US 8,851,435 B1
(45) Date of Patent: Oct. 7, 2014

(54) ROD ASSEMBLY WITH REVERSIBLE LOCKING DEVICE

(75) Inventors: Richard M. Bastien, Cumberland, RI (US); Michael P. Hanley, Smithfield, RI (US)

(73) Assignee: Kenney Manufacturing Co., Warwick, RI (US)

( * ) Notice: Subject to any disclaimer, the term of this patent is extended or adjusted under 35 U.S.C. 154(b) by 89 days.

(21) Appl. No.: 13/420,937

(22) Filed: Mar. 15, 2012

Related U.S. Application Data

(60) Provisional application No. 61/453,124, filed on Mar. 15, 2011.

(51) Int. Cl.
*A47H 1/02* (2006.01)

(52) U.S. Cl.
USPC ..... 248/251; 248/200.1

(58) Field of Classification Search
USPC ..... 248/200.1, 251, 261, 262, 266, 267, 248/268, 252, 254, 255, 256, 257, 258, 259, 248/260, 253; 403/109.1, 109.2, 109.4, 403/109.5
See application file for complete search history.

(56) References Cited

U.S. PATENT DOCUMENTS

| | | | | |
|---|---|---|---|---|
| 912,789 | A * | 2/1909 | Berbecker | 248/262 |
| 2,261,505 | A | 11/1941 | Schlesinger | |
| 2,298,380 | A | 10/1942 | Hood | |
| 2,915,327 | A | 12/1959 | Kreske | |
| 4,152,086 | A | 5/1979 | Achenbach et al. | |
| 4,238,164 | A | 12/1980 | Mazzolla | |
| 4,744,471 | A * | 5/1988 | Leister | 211/7 |
| 4,856,929 | A | 8/1989 | Smahlik et al. | |
| 5,427,288 | A * | 6/1995 | Trubee | 224/539 |
| 5,876,147 | A | 3/1999 | Longo | |
| 6,302,614 | B1 | 10/2001 | Tseng | |
| 2006/0204322 | A1 * | 9/2006 | Roiser | 403/109.5 |
| 2010/0316438 | A1 * | 12/2010 | Sohn | 403/109.1 |
| 2012/0005823 | A1 | 1/2012 | Barnes | |
| 2012/0152874 | A1 | 6/2012 | Didehvar | |
| 2012/0261371 | A1 | 10/2012 | Barnes | |
| 2012/0284914 | A1 | 11/2012 | Bauer | |

* cited by examiner

*Primary Examiner* — Steven Marsh
(74) *Attorney, Agent, or Firm* — C. Nessler

(57) ABSTRACT

A curtain rod assembly comprises a set of telescoping tubes running between brackets and a locking assembly for setting the length of the telescoped tubes. The locking assembly comprises a screw body, attached to the end of the smaller inner tube, which has a tapered screw along which a captive expansible sleeve moves. The sleeve may be a split cylinder with spring elements running across the gap of the split. When the tubes are twisted relative to each other, the sleeve moves lengthwise along the tapered screw and expands radially outwardly to lock the assembly; and simultaneously with the locking action there is a desirable small change in the length of the tube assembly. The screw body is reversible within the tube assembly, so the rod assembly can be used in applications where the rod both pulls inwardly on, or pushes outwardly against, a window frame.

10 Claims, 3 Drawing Sheets

ROD ASSEMBLY WITH REVERSIBLE LOCKING DEVICE

This application claims benefit of provisional patent application Ser. No. 61/453,124 filed on Mar. 15, 2010

TECHNICAL FIELD

The present invention relates to adjustable length rods which are secured in position in connection with openings in structures, especially curtain rods.

BACKGROUND

Curtain rods which are sold for domestic use must be adjustable to a variety of sizes of window, door and other openings. Commonly, rods have been adjustable within limits, so a particular rod product may be made to fit a particular opening size at the time a user installs a rod.

The present invention relates to curtain rods comprised of round two-piece hollow tubes, where one part telescopes within the other part, so the length is adjustable to fit a window or door opening. Many such prior art rods run between opposing side brackets. The brackets may be screwed or nailed to the opposing sides of the frame of the opening. However, for convenience of installation, and to avoid damage to the frame, curtain rods have heretofore been held in place by means of frictional engagement of the rod ends with the opposing sides of a window frame or the like. It follows that there must be means for exerting sufficient force against the window frame surfaces, so the weight of the rod and any associated curtain or other window treatment is supported by frictional engagement; and, that means must be compatible with the need for having adjustable length of the rod.

Another market place need is that a curtain rod of the foregoing type should be suited for easy installation by an average householder without the use of tools. While there are various designs which are previously known for accomplishing the needs, including those which include tubular rods which have internal springs or mechanical locking mechanisms, there is a continuing need for improved designs which have a better combination of simplicity of installation, good functionality, and economy of manufacture.

SUMMARY

An object of the invention is to provide a telescoping curtain rod which has good frictional engagement with different size window frames. A further object is to provide a simple and economic means for a user to install such a rod in a window frame. A further object is to make a telescoping curtain rod which can be adapted to either pushing or pulling on the edges of a frame, according to whether its primary engagement is with the inward or outward edges of the frame.

In accord with the invention a rod assembly suited for supporting curtains and the like comprises a tube assembly, namely two tubes which telescope together, and a locking assembly which holds the tubes in a fixed lengthwise relationship. A locking assembly comprises a screw body which has a tapered threaded portion that is intermediate the two screw body ends. An internally threaded and expansible sleeve circumscribes the threaded portion. The sleeve expands radially outwardly to engage the bore of the larger tube as the sleeve moves along the length of the threaded portion of the screw body In an embodiment of the invention, prior to locking the tubes together, when the sleeve is located at the smaller diameter end of the thread of the screw body, the sleeve is lightly frictionally engaged with the bore of the larger diameter tube, so it can be rotated, while it is still slippable lengthwise within the bore. In different embodiments of the invention that may be accomplished by the shaping or sizing of the sleeve; by making the sleeve of resilient material; by having only one end of the sleeve expanded radially outwardly as a result of its lengthwise position along the taper of the threaded portion; or by spring like members running across the gap of a lengthwise split sleeve; or by combinations of the foregoing.

In an embodiment of the invention, a first end of the screw body is fastened to the inward end of the smaller of the two telescoping tubes. (Inward refers to a direction which runs toward the center of a framed opening.) The other or second end of the screw body rotates and slides within the bore of the larger tube. When the tubes are rotated appropriately relative to each other, the resilient sleeve is rotated and thus moves along the length of the tapered thread of the screw body toward the larger diameter thread portion. The sleeve is thereby expanded, so it presses against the bore of the larger diameter tube. Ultimately, the point is reached where the sleeve jams and the tubes are locked relative to one another. As that point of locking is approached the sleeve imparts thrust to the outer tube, thrusting it in a direction which expands or contracts the length of the assembly a small amount, depending on which direction the tapered threaded portion is oriented. Preferably, both the first and second ends of the screw body are large enough in diameter to capture the sleeve lengthwise on the screw body.

In an embodiment of the invention, the second end of a locking mechanism screw body is shaped to alternately fit within a smaller tube or a larger tube, which tubes are telescopcable and rotatable relative to each other. Thus, the screw body is reversible in orientation within a tube assembly. When the screw body orientation is reversed, the ends of the telescoped tubes will be pulled slightly inwardly, instead of being pushed slightly outwardly upon twist-locking of the locking assembly. Thus the rod assembly is suited for installations where the maker or user wants the brackets to engage the outer edges of a window frame and pull inwardly; or where the user wants the brackets to engage the inner edges of a window frame and push outwardly.

The invention provides an improved and more effective adjustable length telescopic tube rod for curtains and other uses. The invention enables a product to be converted between tube-end pulling and pushing with the same parts, excluding possibly the brackets. The same locking assembly may be used in manufacturing different products. The invention will ordinarily be shipped as a kit for full or final assembly by the user.

The foregoing and other objects, features and advantages of the present invention will become more apparent from the following description of preferred embodiments and accompanying drawings.

DESCRIPTION

Figure 1:
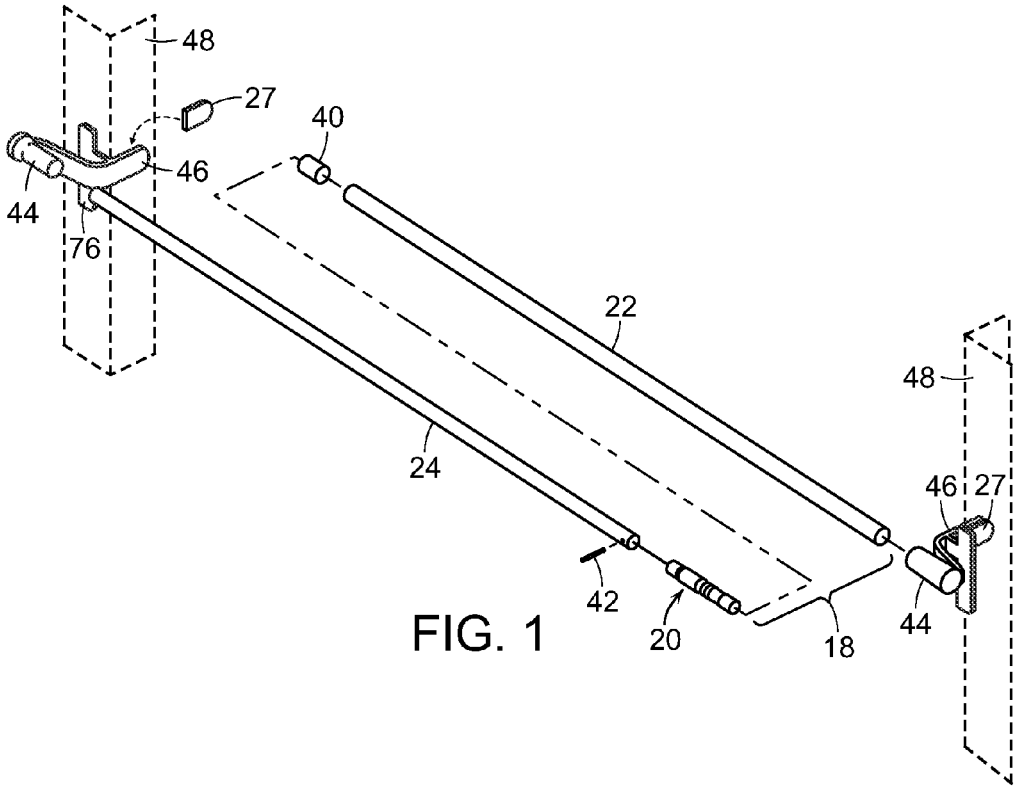
FIG. 1 is an exploded perspective view of a telescoping tube curtain rod assembly in working position at the opening of a window frame shown in phantom, where the ends of the curtain rod press outwardly on the window frame.

FIG. 1 is an exploded view of an embodiment of curtain rod assembly 18 in accord with the present invention. The assembly runs between mounting brackets which fit within, and press against, the opposing side vertical frames of a window opening or the like, shown in phantom. The curtain rod assembly is comprised of two mutually telescoping tubes 22, 24 and a locking assembly 20. When the tubes are twisted relative to one another, the locking mechanism holds the tubes in a fixed length telescoped position. During the locking process, the locking mechanism preferably exerts a thrust (outwardly in the FIG. 1 embodiment). A reference herein to the "rod" or "curtain rod" is a reference to the rod assembly. Typically, the rod assembly will be used in a home, and the user will hang a curtain or other window or door treatment from the rod assembly. A treatment in the present context may include such as fabrics, both opaque and shear, blinds, drapes, shades and the like.

To keep the curtain rod 18 shown in FIG. 1 in place against gravity and weight of a curtain, there must be an outward or thrusting force applied to the frame by having the ends of the tubes press on the brackets. The force must be sufficient to create a frictional engagement between the brackets and frames that is sufficient to resist the expected downward forces. That is accomplished by creating resilient forces in the rod assembly that are sustained after the rod assembly is locked and in place relative to a window frame.

Figure 3:
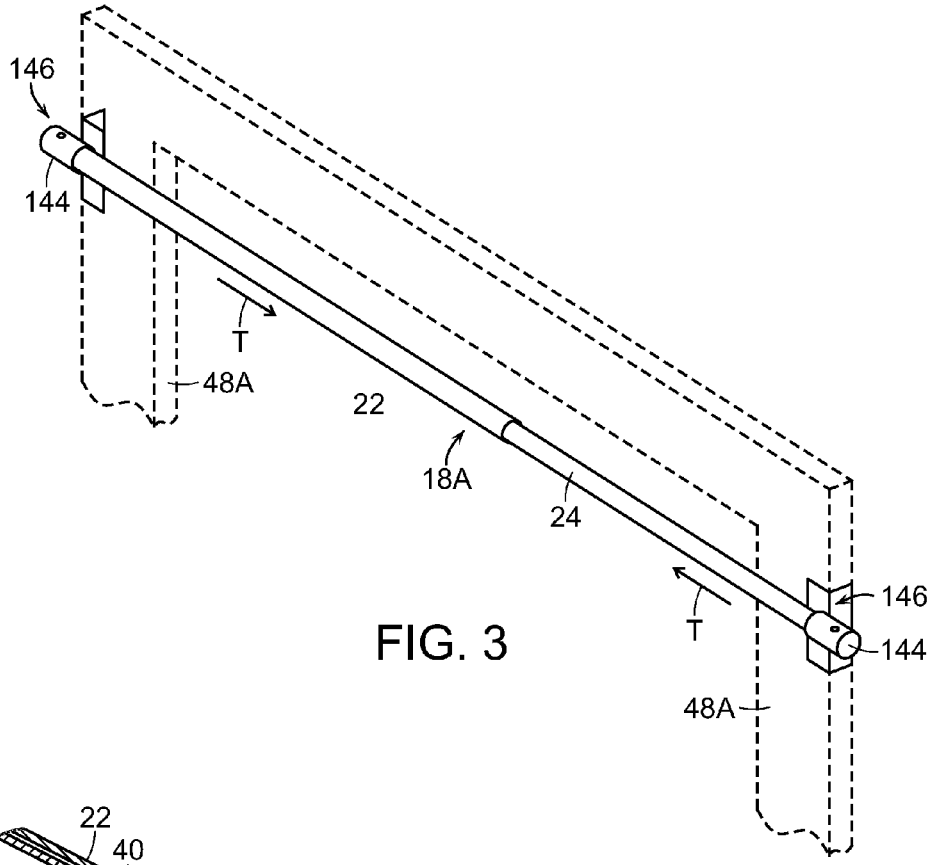
FIG. 3 is a view like FIG. 1, showing a curtain rod assembly in working position at the opening of a window frame, where the ends of the curtain rod pull inwardly on the frame.
Figure 4:
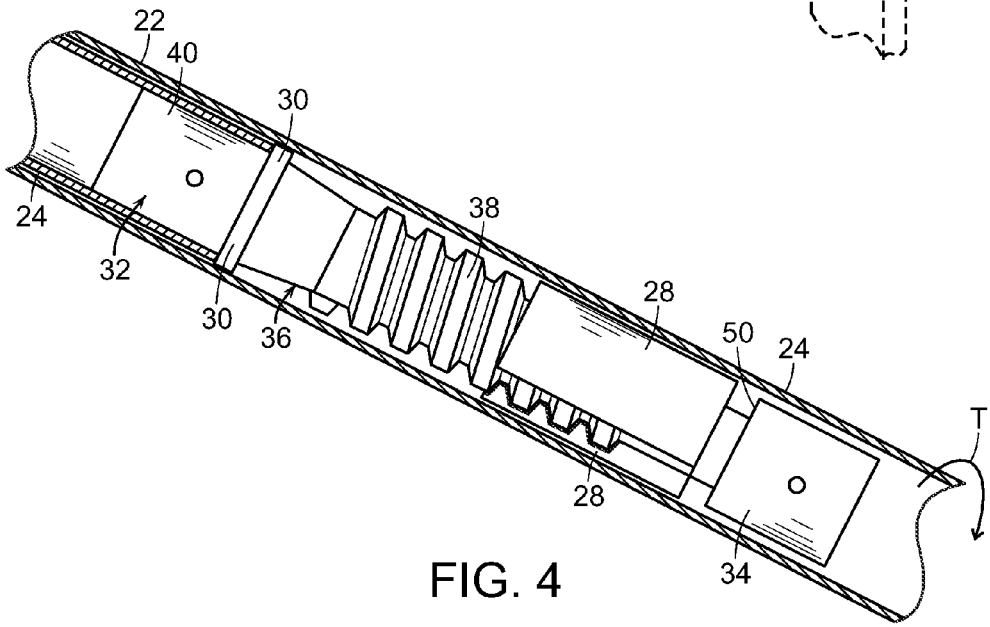
FIG. 4 is a side view like FIG. 2, showing same locking assembly as pictured in FIG. 2, but with an orientation that pulls the telescoping tubes toward each other.

A feature of a locking assembly of the present invention is that it may be reversed in orientation within a curtain rod assembly, so that with the same components, excluding perhaps the brackets, the curtain rod may be configured to alternatively either push outwardly the ends of the curtain rod and any associated mounting brackets, or pull them inwardly. The invention is described first in terms of the outward pushing mode. The inward pulling mode, shown in FIG. 3 and FIG. 4 are described later.

In the apparatus shown in FIG. 1, opposing side brackets 46 have outward-facing right angle vertical surfaces for engaging window frames 48, shown in phantom. See also FIG. 9, discussed further below. Each bracket 46 has a socket 44, within which is received the outer end of one of the hollow tubes 24, 22. Alternatively, each bracket may have an inward-projecting cylindrical stub, not shown, on which is received the hollow end of a tube. "Inward" as used herein without qualification generally refers to a direction which runs to the center of the window frame opening in which a curtain rod is installed for use.

Brackets 46 may be made of molded plastic; alternatively, of metal of other material. Thin pads 27 of elastomeric material such as rubber are preferably interposed between each bracket and the inward facing surface of the frame 48, e.g., to enhance frictional engagement and accommodate irregularities. Alternately, each bracket may have small protuberances which press into an accommodating frame surface. Tubes 22, 24 may be optionally fastened to the brackets if desired, as by screws, pins, press fit, adhesives, etc., to ease placement of the assembly.

Figure 9:
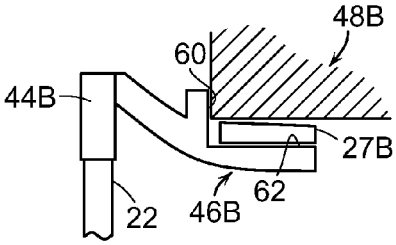
FIG. 9 is a top view showing a bracket useful with the curtain rod assembly of FIG. 1

FIG. 9 shows in top view a bracket 46B that is generally like bracket 46, engaged with window frame 48B. Bracket 46B preferably has a vertically extending portion, not visible, like the plate 76 shown in FIG. 1 for bracket 46, to resist the torsional moment that results from the spacing apart of tube 22 and socket 44B from the front face of the window frame. Bracket 46B has two spaced part orthogonal faces 60, 62 for bearing on the exterior corner of window frame 48B; in the case of face 62, the bearing is achieved through the intermediary of wedge shape rubber pad 27B. The flat end of the pad may have a bump or the like to conveniently located it laterally. The wedge, or thickened, portion that is nearer to the corner of the frame provides enhanced frictional engagement, particularly in context that there is ordinary deflection of the portions of a bracket when there is a thrust load applied by the tube 22.

Tubes 22, 24 may be made of lightweight steel tubing of about 0.5 to 0.7 inch diameter and wall thickness of about 0.02 inch; alternatively they may be made of aluminum or a strong plastic. The outside diameter of tube 24 is slightly smaller than the inside diameter of tube 22, for example about 0.010 to 0.040 inch smaller. When assembled, the inner end of smaller tube 24 is positioned within and slidable lengthwise within the inner end of the larger tube 22. The fit between the tubes is close, so any bending at the joint between the tubes is minimized.

Figure 2:
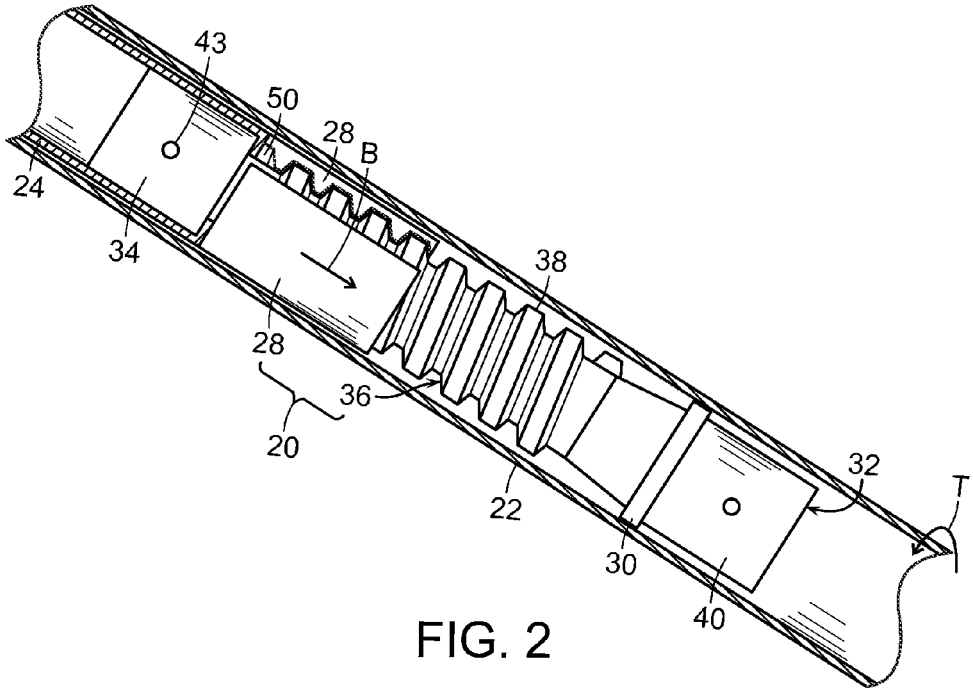
FIG. 2 is a side view of a locking assembly, in its working position within the rod assembly of FIG. 1.

When installed in a window frame, the tubes 22, 24 lock lengthwise relative to each other by means of locking assembly 20 which fits within the cylindrical interiors of the assembled tubes 22, 24. With reference to FIG. 2, locking assembly 20 is comprised of a screw body 36 and an internally threaded sleeve 28 which fits around the screw body. Both pieces are preferably made of molded plastic such as polypropylene or nylon. The internal threads of sleeve 28 engage the external thread 38 of the screw body 36; and as pictured, the threaded portion is tapered.

Figure 10:
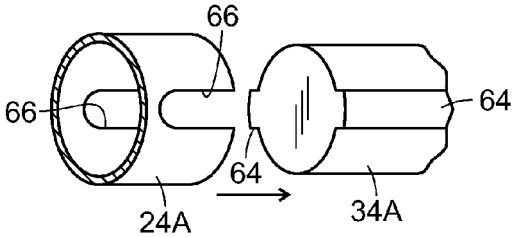
FIG. 10 is an oblique view of the end of a screw body and a mating end of a tube, showing how they engage for anti-rotation relative to each other.

Screw body 36 has a first end 34 which fits within the end of smaller tube 24 and a second end 32 with fits within larger tube 22. The end 34 fits closely within tube 24 and is engaged with it in a way such that rotation of tube 24 rotates the screw body. As shown in FIG. 1 and FIG. 2, this may be accomplished by roll pin 42 which fits within hole 43 of the screw body end. Alternative means for connecting the two parts may be used, so they are anti-rotation. For example, as shown in FIG. 10, end 34A may have opposing side lobes 64 which slide into opposing side slots 66 of the end of tube 24A. (Generally, numbered elements with suffixes correspond to number elements without suffixes.) Other means for rotatably connecting the screw body to a tube may be used, including other fasteners, dimpling, swaging, adhesives, etc.

Referring again to FIG. 1 and FIG. 2, the opposing cylindrical end 32 of screw body 36 is received within the inner end of larger hollow tube 22. End 32 is comprised of flange 30 and smaller diameter portion 40. Flange 30 fits closely the bore of tube 22. To fit closely means that there diameter of the inner piece, e.g., flange 30, has a slip fit with the bore of the receiving piece, e.g., tube 22. The usefulness of the smaller diameter portion 40 is described below. The fit of the end 32, in particular flange 30, and tube 22 is such that they may rotate relative to each other, and that end 32 can slide lengthwise within the bore of tube 22. In an alternate embodiment end of locking assembly, which is not reversible as described below, the whole of the end 32 may have the diameter of flange 30 or the diameter of portion 40.

Sleeve 28 has a threaded bore, the internal threads of which engage the external threads of screw 38 of screw body 36. In the embodiment shown in FIG. 2, sleeve 28 is split lengthwise. Sleeve embodiments are discussed further below. As mentioned, the screw 38 of screw body 36 is tapered and thread diameter increases with increasing distance from end 34 and tube 24. The taper may be vary within the invention. For example, the taper may fit a regular cone; or the taper may fit a curved cone, or the smaller end of the screw (nearest screw body end 34) may be constant diameter. The fit of the mating threaded parts 28, 38 within each other is sufficiently loose to enable the motions which are described just below.

Figure 11:
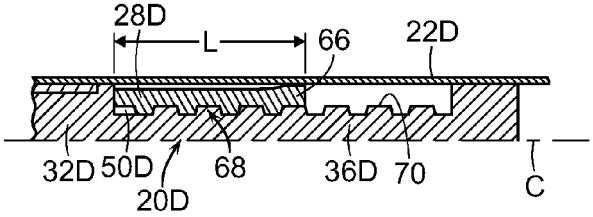
FIG. 11 is a partial lengthwise cross section of a locking assembly showing a sleeve partially engaged the bore of a tube.

The outside diameter of sleeve 28 is dimensioned so that, when the sleeve is mounted on the screw body and inserted within tube 22 with the sleeve in its home position (that nearest to the end 34), at least part of the sleeve exerts a light resilient outward force against the bore of the tube 22, sufficient to cause the sleeve to rotate about the screw body when the tube 22 is rotated relative to the body. Yet, the fit of sleeve and tube is sufficiently loose to also allow the sleeve to move lengthwise within the bore of the tube, so that with sufficient turning or twisting, the sleeve becomes wedged in place as it moves toward the larger end of the tapered screw 38. The desired fit and frictional engagement between the sleeve at its home position and bore of tube 22 may be achieved by different means. For instance, the fabricated shape of the sleeve may create a light interference fit with the bore; the sleeve may be elastically loaded so it springs outwardly against the bore; part of the sleeve may be preferentially pressed against the bore, either due to the shape of the sleeve or because an end of the sleeve is thrust outwardly by the thread taper in its home position, as shown in FIG. 11 and discussed below.

The threaded portion of an exemplary screw body is about 1.4 inch long and has an about one-quarter inch pitch, a 3 to 4 degree include angle taper and a large end minor diameter of about 0.35 inch. An associated sleeve may be about three quarters of an inch long.

With reference to FIGS. 1 and 2 again, when the parts are assembled and tube 22 tube 24 are rotated relative to each other, screw body 36, being rotatably fastened to tube 24, rotates relative to tube 22 and relative to frictionally engaged sleeve 28. When the screw 38 of an exemplary device is a right hand thread, counterclockwise motion (as gauged by looking at end 34, and as indicated by arrow T) causes the sleeve to move to the right (indicated by arrow B) relative to the screw body, and toward the increasing diameter end of the threaded portion 38, i.e., toward end 32 of the screw body. As sleeve moves toward the increased thread diameter portion of the screw body, it is increasingly expanded in diameter and pressed outwardly against the bore of tube 22, finally reaching the point where there is jamming force between the screw body, the sleeve and tube 22. At that point the tubes are locked lengthwise and rotatably to each other. This action is referred to a tightening the assembly. Twisting the tubes in the reverse direction will loosen the assembly.

The forces which cause frictional engagement between the sleeve and tube will also create a frictional force between the sleeve and screw body thread. The frictional forces coupled with small distortion of resilient plastic parts of the device inhibit un-turning or counter-rotation of the parts. On the other hand, a user can overpower those frictional forces by reversing the twisting motion associated with tightening, and thus can loosen the locking assembly and remove the curtain rod from its locked-in position.

Figure 5:
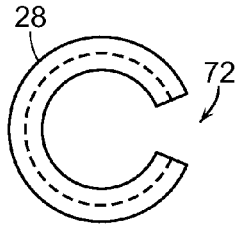
FIG. 5 is an end view of a threaded split-sleeve used in a locking assembly.

The following details some features of sleeve 28 and alternatives. Sleeves are substantially cylindrical when installed in the locking assembly; as detailed by example below, the deviation from exact cylindricalness may vary when the sleeve is first fabricated—due to intent or manufacturing variations, or at the sleeve may be distorted because of it engagement with increasing taper of the threaded portion of the screw body. Sleeve 28 is split, both to enable its initial placement around the screw body 36, and to allow it to expand in dimension as it moves toward the larger diameter end of tapered screw 38. Sleeve 28 may be molded, using the same material as used for the screw body, as one piece with a lengthwise gap or split 72, as shown in FIG. 5. Such kind of sleeve is capable of being opened sufficiently so the split 72 becomes big enough to enable the sleeve to be "snapped onto" the threaded part 38 of the screw body.

Figure 6:
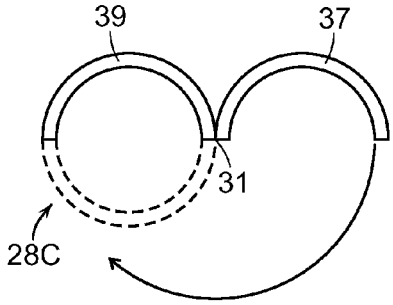
FIG. 6 is an end view of an embodiment of threaded split-sleeve comprising a living hinge.

Alternately, with reference to FIG. 6, a sleeve 28C may be formed as a molded plastic structure with a so-called living hinge, i.e., a thin section capable of bending in simulation of a pinned hinge. The threaded two half cylinders 37, 39, connected by living hinge 31, are swung together to form sleeve 28C, as shown in phantom, capturing screw 38 of the screw body. The dimensions of the sleeve are selected when it is molded so that to put the sleeve in place within the bore of a tube, the split 72 must be decreased, and thus in the installed condition there will be a resilient outward thrust of the sleeve, toward the bore of the tube.

Figure 7:
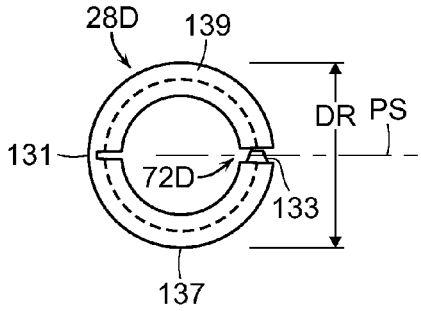
FIG. 7 is an end view of an embodiment of threaded split-sleeve comprising a living hinge and conical bumpers at the split location.

FIG. 7 shows a sleeve 28D which has a living hinge 131 and semi-circle parts 137, 139, like the sleeve 28C. At the split 72D there are several truncated cones 133 spaced part along the length of edge of part 137. The apexes of cones contact the edge of part 139 which defines the split. Since the cones have small cross sectional area compared to the adjoining parts of the sleeve halves, the cones will preferentially and more easily deform when the sleeve outside diameter is decreased, as by inserting it within a tube. When the sleeve is in the unlocked or home position there will be the desired frictional engagement with the tube bore which is mentioned above. To that end, sleeve 28D is molded so that the nominal diameter DR (measured perpendicular to the mean plane PS of the split 72D) is larger than the diameter of the bore of the tube in which it is received, e.g., tube 22. Thus, when the sleeve is installed, the cones, having an aggregate cross sectional area less in plane PS which is less than the cross sectional area of the sleeve which is adjacent the split, are compressed and thus provide a resilient outward thrust, toward the bore of the tube. Other features than cones may be used for the spring elements. For instance, when the elements are integral, as are the cones 133, the protuberances which project from one edge of the gap to the other edge of the gap may comprise one or more constant diameter cylinders, or tapered or constant width buttes, where the aggregate cross sectional area in a lengthwise cross sectional plane PS is substantially less than the cross sectional area of the portions of the sleeve adjacent the split. In other embodiments, metal or plastic coil spring elements inserted into pockets in the face of one edge may be used; leaf springs may be used.

In another embodiment, the sleeve may be comprised of two or more lengthwise separate segments, since the segments will be captured within the large tube once the locking assembly is put together. In still another embodiment, the sleeve does not have a split and is formed of an elastomeric material, e.g., rubber, which has sufficient elasticity to enable the sleeve to be stretched, rather than split apart, as it moves along the screw to the larger diameter end of the screw. Likewise, the sleeve is sufficiently stretchable to enable it to be put in position around the screw, in the first place.

FIG. 11 is a partial lengthwise cross section of a locking assembly 20D showing a resilient sleeve 28D partially engaged with the bore of tube 22D. Screw body 36D has a nominally constant diameter threaded portion 68 and a tapered portion 70. The length L of sleeve 28D is such that in its home or retracted position with the left end of the sleeve hitting the shoulder 50D which demarcates end 32D, as shown, the sleeve right end 66 is on a tapered part of the screw, the diameter of which is sufficient to cause expansion of that end of the sleeve, so it presses radially outward against the bore of tube 22D. In the FIG. 11 picture the distortion of end 66, and the clearance (which may be zero) between the rest of the sleeve and the bore of the tube, are much exaggerated for purpose of illustration.

In a variation related to how the FIG. 11 embodiment works, a sleeve may be molded so that the exterior surface has a circumferential ridge simulative of the distortion 66. In carrying out this and other embodiments, the small end of the screw may have a constant diameter. Thus, when the sleeve is at the small end of the screw the sleeve is not being expanded radially; but the thicker sleeve provide at the circumferential ridge location provides the desired home-position frictional engagement of the sleeve with the bore of the tube.

The configuration of the locking assembly is such that upon disassembly, as when the direction of thrusting is reversed, the sleeve is retained on the screw body. In the embodiments of FIG. 2 and FIG. 4 a sleeve cannot move lengthwise beyond the point of engagement with the shoulder 50 of end 34 (when moving to the left in FIG. 2, to the right in FIG. 4) or beyond the point of engagement with flange 30 (when moving to the right in FIG. 2, to the left in the FIG. 4). This construction provides convenience in that there is retention of locking system integrity during use and disassembly. Also, that construction can assure that the minimum diameter of the sleeve does not become less than that which is needed to assure some minimal frictional engagement of the sleeve with the larger tube.

In other less preferred embodiments, the sleeve will not be captured lengthwise on the screw body. For instance, in FIG. 4 the end 34 may have an outside diameter which is equal or less than the diameter of the small end of the threaded portion. Such a screw body would not be reversible as the case when the end has two different diameters.

Figure 8:
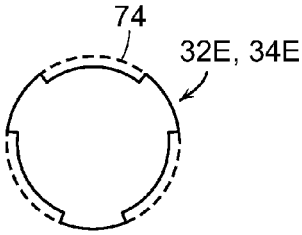
FIG. 8 is an end view of an end of the locking assembly which has a non-circular shape.

While the ends 34, 32 of a screw body are preferably round, they may have other shapes. For example, the end 32B of locking assembly 20B, when viewed from the end could be a rectangle, or a multiplicity of lobes, or of some other cross sectional shape. FIG. 8 shows an end view of a non-circular, or three lobe end 32E, 34E, which may characterize either or both ends of the screw. In these embodiments, only lands, or parts of a circular segment, would fit and contact the bore of a tube in which the end is inserted, e.g. the diameter 74 in FIG. 8. When an end is non-circular in cross section shape, a reference herein or in a claim to the diameter of an end shall refer to that diameter which circumscribes the outer periphery of the end Other means than the aforementioned pinning may be used for fastening a screw body end to a tube, for instance for fastening screw body end 34 to tube 24. For example, the end may be attached by mechanical fasteners such as screws, pins, staples, etc.; or the tube end may be swaged around the end, or the parts may be press fitted together, or adhesives may be used.

The rod assembly of the type shown in FIG. 1 can be installed for use in two ways: In one approach, the rod is twisted and locked at a certain length prior to final placement of the rod within the brackets and window frame. The certain length can be chosen by small trial and error experiment at the point of installation. The certain length is that which is slightly longer than a plain close fit would dictate. That is, the rod will be locked so it has a length that is over-long, to the extent that, to put it in place, requires a certain degree of force. The result of such is upon putting the rod in place, either some or all of the following occur: The resilient pads 27 are elastically compressed, there is slight elastic bending of the tube assembly; there is elastic bending of the brackets. Thus after placement there is residual elastic thrusting force applied to the window frame, sufficient to hold the brackets and rod in place against vertical forces that are present during use.

In another approach, the rod and brackets are positioned in the opening and the tubes are manually thrusted outwardly and simultaneously twisted to cause locking. When the locking assembly is tightened by twisting there is a small lengthwise extension of the ends of the curtain rods as a result of the sleeve moving lengthwise while being simultaneously thrust radially outwardly by the screw. Such desired lengthwise extension occurs and can be sufficient with the right combination of the fits and shapes of parts, compliances to loads, surface characteristics, and the installer's technique.

The invention can also be used in situations where the ends of the tubes are drawn closer together. FIG. 3 and FIG. 4 correspond with the views of FIG. 1 and FIG. 2, and illustrate the alternative mode of the invention.

Figure 12:
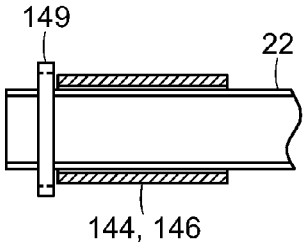
FIG. 12 is shows a portion of a bracket comprising a socket, within which is positioned a pinned tube.

As shown, the ends of the telescoped tubes 22, 24 are positioned within the sockets 144 of brackets 146 which have orthogonal plate-like portions for engaging the front and outward surfaces of window frame 48A, shown in phantom. The ends of the tubes are secured to the sockets so they can pull lengthwise on the brackets, as by being pinned. Preferably, at least one of the ends is rotatable, so that in accord with the second installation approach mentioned above, the one tube can be rotated to lock the rod while it is in place. For example, as shown in FIG. 12, one of the ends may be secured by pin 149 that goes into a through hole at the end of tube 22, where the end projects beyond the outer end of socket 144 of bracket 146.

Examination of FIG. 4 will show that the screw body has the same configuration of the screw body of FIG. 2, but since the orientation within the tube assembly is now reversed, turning of tube 24 (in clockwise direction indicated by arrow T, when viewing the end 34 of the screw body) causes sleeve 28 to move to the left, thereby expanding the sleeve and simultaneously jamming the sleeve against the bore of tube 24 while imparting an inward thrusting force.

The advantage of having the smaller diameter portion 40 on the screw body can be seen, as it is sized to fit within the bore of smaller tube 24. As was the case in the pulling mode, end 32, 40 is at least rotatably affixed to the end of tube 24. End 34 is now suspended within the bore of the larger tube 22. If desired, a bushing could be placed around end 34 so there is a sliding fit with tube 22 bore. Note that the diameter of the bore of the sleeve is such that it is inhibited from coming off the screw body by the dimension of end 34.

The variations in construction and alternative ways of carrying out the invention described with respect to FIGS. 1 and 2 and the first pushing mode continue to be applicable to carrying out the invention with respect to FIG. 3 and FIG. 4 and the second pulling mode.

In still other alternate embodiments of the invention, the direction of taper of the threaded portion of the screw body can be reversed from that shown in the FIG. 2 and FIG. 4. Thus, in the example of FIG. 2, turning the tubes to lock the assembly would slightly contract the tube assembly upon locking.

Thus, in the generality of the invention the screw body has a tapered threaded portion with the smaller diameter threaded end near either the first or second end of the screw body; and, rotating of one tube relative to the other will cause the sleeve to move to or from the first end of the screw body, according to the direction of taper of the threaded portion.

While the invention has, in the examples, been described in terms of a right hand screw thread, a left hand screw thread can be substituted, whereupon the direction of rotation of the tubes or locking would be reversed. A user can easily determine which direction of rotation to use and can detect in which direction is small change in length associated with tightening the locking assembly.

In another embodiment of the invention, the locking assembly is as pictured in FIG. 4, but the end 34 has a diameter which closely and slidably fits within the bore of tube 24. Such a locking assembly would be suited uses where the reversibility feature of the locking system embodiment in FIG. 2 and FIG. 4 is not needed.

In alternate embodiments, a locking assembly 20 may be used in combination with curtain rod tubes, the ends of which press directly against the frames, or where the tubes or brackets press or pull with respect to structures other than window frames or brackets, or where no pressing or pulling action is required, and where the rod simply rests in place, as when the brackets are fastened to the window frame. Also, the combination of tube assembly and locking assembly may be used with brackets that do not have to be pulled or pushed relative to a frame, for instance when the brackets are fastened to the frame or adjacent structure.

The way of adjusting and installing telescopic tube rods is much improved by the invention. The outward or inward thrust which occurs upon locking is advantageous. The dual use of the locking assembly, to in-pulling and out-thrusting devices, can provide lower tooling and manufacturing cost for products. A product can be converted in the field, as by a customer, between tube-end pulling and tube-end pushing with the same parts, excluding possibly using different configuration brackets. A product that is disassembled, or shipped in knock-down condition, will have more integrity since the sleeve is reliably captured on the screw of the locking device.

While in the examples of the invention have been in connection a window frame, the invention may be used in other applications. For instance, the invention may be used in connection with shower rods, and pole caddies used in shower enclosures. And the invention may be used for vertical poles, for example as used for supporting lamps and other things between a floor and ceiling; or for preventing lateral motion of things contained on shelves.

The invention, with explicit and implicit variations and advantages, has been described and illustrated with respect to one or more embodiments. Those embodiments should be considered illustrative and not restrictive. Any use of words such as "preferred" and variations suggest a feature or combination which is desirable but which is not necessarily mandatory. Thus embodiments lacking any such preferred feature or combination may be within the scope of the claims which follow. Persons skilled in the art may make various changes in form and detail without departing from the spirit and scope of the claimed invention.

What is claimed is:

1. A rod assembly, for supporting a curtain or other treatment at a window or door opening in a structure, which comprises:

two brackets, each shaped for contacting a spaced apart portion of the structure which defines at least a portion of said window or door opening, each bracket having a portions shaped for receiving a second end of a tube;

a tube assembly comprising (i) a first tube having a first end, a second end, and a bore;

(ii) a second tube, smaller in diameter than the first tube, having a first end thereof partially positioned within the bore of the first end of the first tube;

wherein the first and second tubes are rotatable relative to each other and telescopable relative to each other to enable change in overall length of the tube assembly; and, wherein the second end of the first tube is engaged with a first bracket and the second end of the second tube is engaged with the second bracket; and, a locking assembly, captured within the tube assembly proximate the first end of the second tube, comprising (i) a screw body having a first end having a first portion shaped to fit within the bore of the first tube and a second portion shaped to fit closely within the bore of the second tube;

a second end rotatably secured within the bore of the second tube; and an externally threaded portion intermediate the first and second ends, the portion having an external diameter which decreases with distance from either the first end or the second end; and, (ii) a sleeve, circumscribing said threaded portion of the screw body, having a threaded bore and an exterior surface portion frictionally engaged with the bore of the first tube;

wherein rotation of one tube relative to the other tube causes the sleeve to move to or from said first end of the screw body, to thereby radially expand or contract the sleeve, wherein radially outward expansion of the sleeve locks the telescoped tubes lengthwise with respect to each other.

2. The rod assembly of claim 1 wherein the diameter of the threaded portion of the screw body decreases with distance from the second end of the screw body, and wherein the sleeve expands outwardly when the sleeve moves toward the second end of the screw body.

3. The rod assembly of claim 1 wherein said first portion of the screw body is a flange which circumscribes the screw body adjacent said second portion of the screw body.

4. The rod assembly of claim 1 wherein said spaced apart portions of the structure are surfaces which face inwardly toward each other; and, wherein said brackets are shaped and configured for receiving forces applied by the tube assembly which press the brackets outwardly against said inward facing portions.

5. The rod assembly of claim 1 wherein said sleeve has a circumscribing ridge at one end; wherein, when the sleeve is positioned at the smaller end of the threaded portion, said ridge presses against the bore of the first tube.

6. The rod assembly of claim 1 wherein the sleeve is captured lengthwise on the screw body by the first end and the second thereof.

7. The rod assembly of claim 1 wherein the sleeve has a lengthwise split and one or more resilient protuberances projecting across the split from one edge of the split to the opposing edge of the split.

8. The rod assembly of claim 1 wherein the first end and the second end of said screw body have substantially cylindrical shapes.

9. The rod assembly of claim 1 wherein the sleeve is selected from amongst: a split sleeve, a living hinge sleeve, and a resiliently expansible sleeve.

10. A kit of parts for hanging curtains or other treatments at a window or door opening in a structure, which comprises:

(a) two brackets, each shaped for contacting a spaced apart portion of the structure which define at least a portion of said window or door opening, each bracket configured for receiving a second end of a first or a second tube;

(b) a first tube having a first end, a second end, and a bore;

(c) a second tube, smaller in diameter than the first tube, having a bore and having a first end shaped for being at least partially positioned within the bore of the first end of the first tube, to form a tube assembly;

wherein the second end of the first tube and second end of the second tube are shaped for engagement with a tube-receiving portion of a bracket;

wherein when the first and second tubes are mated to form an assembly as aforesaid, the first and second tubes are rotatable and telescopable relative to one another; and, (d) a locking assembly, shaped for fitting within said tube assembly proximate the first end of the second tube, comprising (i) a screw body having a first end having a first portion shaped to fit within the bore of the first tube and a second portion shaped to fit closely within the bore of the second tube;

a second end shaped to be received within the bore of the second tube; and an externally threaded portion intermediate the first and second ends having an external diameter, the diameter decreasing with distance from either the first end or the second end; and, (ii) a sleeve, shaped for circumscribing said threaded portion of the screw body, the sleeve having a threaded bore and an exterior surface portion for frictionally engaging the bore of the first tube;

wherein, when the locking assembly with sleeve thereon is mated with said tube assembly, rotation of one tube relative to the other tube causes the sleeve to move to or from said first end of the screw body, to thereby radially expand or contract the sleeve, wherein expansion of the sleeve locks the telescoped tubes lengthwise with respect to each other.

* * * * *